US008454768B2

(12) United States Patent
Fanning

(10) Patent No.: US 8,454,768 B2
(45) Date of Patent: Jun. 4, 2013

(54) NEAR-BETA TITANIUM ALLOY FOR HIGH STRENGTH APPLICATIONS AND METHODS FOR MANUFACTURING THE SAME

(75) Inventor: John Fanning, Henderson, NV (US)

(73) Assignee: Titanium Metals Corporation, Exton, PA (US)

( * ) Notice: Subject to any disclaimer, the term of this patent is extended or adjusted under 35 U.S.C. 154(b) by 0 days.

(21) Appl. No.: 13/433,458

(22) Filed: Mar. 29, 2012

(65) Prior Publication Data

US 2012/0181385 A1 Jul. 19, 2012

Related U.S. Application Data

(63) Continuation of application No. 12/790,502, filed on May 28, 2010.

(60) Provisional application No. 61/182,619, filed on May 29, 2009.

(30) Foreign Application Priority Data

Jul. 6, 2009 (GB) ..... 0911684.9

(51) Int. Cl.
*B64C 25/02* (2006.01)

(52) U.S. Cl.
USPC ..... 148/669; 148/566; 148/671

(58) Field of Classification Search
USPC ..... 148/669, 566, 671; 420/418
See application file for complete search history.

(56) References Cited

U.S. PATENT DOCUMENTS

| | | | |
|---|---|---|---|
| 2,804,409 | A | 8/1957 | Kessler et al. |
| 3,151,003 | A | 9/1964 | Vordahl |
| 6,800,243 | B2 | 10/2004 | Tetyukhin et al. |
| 7,332,043 | B2 | 2/2008 | Tetyukhin et al. |
| 2007/0102073 | A1 | 5/2007 | Veeck et al. |
| 2008/0011395 | A1 | 1/2008 | Matsumoto |

FOREIGN PATENT DOCUMENTS

| | | | |
|---|---|---|---|
| EP | 1 302 554 | A1 | 4/2003 |
| EP | 1 302 555 | B1 | 9/2006 |
| GB | 776440 | A | 6/1957 |
| GB | 782564 | A | 9/1957 |
| GB | 796781 | A | 6/1958 |
| GB | 916801 | A | 1/1963 |
| RU | 2 122 040 | C1 | 11/1998 |

OTHER PUBLICATIONS

UK Office Action dated Sep. 7, 2009, and Search Report dated Sep. 4, 2009, for corresponding UK Appl. No. GB 0911684.9.
UK Office Action dated May 13, 2010 for corresponding UK Appl. No. GB 0911684.9.

(Continued)

*Primary Examiner* — Jie Yang
(74) *Attorney, Agent, or Firm* — Locke Lord LLP

(57) ABSTRACT

A high strength near-beta titanium alloy including, in weight %, 5.3 to 5.7% aluminum, 4.8 to 5.2% vanadium, 0.7 to 0.9% iron, 4.6 to 5.3% molybdenum, 2.0 to 2.5% chromium, and 0.12 to 0.16% oxygen with balance titanium and incidental impurities is provided. An aviation system component comprising the high strength near-beta titanium alloy, and a method for the manufacture of a titanium alloy for use in high strength, deep hardenability, and excellent ductility applications are also provided.

1 Claim, 4 Drawing Sheets

OTHER PUBLICATIONS

International Search Report which was mailed Jul. 15, 2010, and received in corresponding international patent application No. PCT/US2010/036679.

Written Opinion of the International Searching Authority which was received for corresponding international patent application No. PCT/US2010/036679.

A. Fitzgerald in "Proceedings of the 1997 International Conference on Titanium Products and Applications," issued by the International Titanium Association on Sep. 1, 1998, pp. 37-41, USA ISBN: 0935297243. Article contained therein by Vladislav V. Tetyukhin entitled "Current State of Russian Titanium Industry and VSMPO; Development of New High Strength Alloys for Aircraft and Civil Engineering."

NEAR-BETA TITANIUM ALLOY FOR HIGH STRENGTH APPLICATIONS AND METHODS FOR MANUFACTURING THE SAME

CROSS-REFERENCE TO RELATED APPLICATIONS

This application is a continuation of U.S. application Ser. No. 12/790,502, filed May 28, 2010, which claims priority under 35 U.S.C. §119(e) to U.S. Provisional Patent Application No. 61/182,619 which was filed on May 29, 2009 and U.K. Patent Application No. 0911684.9 which was filed on Jul. 6, 2009, the entirety of all of which are incorporated by reference as if fully set forth in this specification.

BACKGROUND OF THE INVENTION

I. Technical Field

This disclosure generally relates to a high strength titanium alloy and techniques for manufacture of the same. The alloy is advantageously used for applications wherein high strength, deep hardenability, and excellent ductility are a required combination of properties.

II. Background of the Related Art

Conventionally, various titanium and steel alloys have been used for the production of aviation components. The use of titanium alloys is favorable since it results in lighter components than those made from steel alloys.

An example of such a titanium alloy is disclosed in U.S. Pat. No. 7,332,043 ("the '043 patent") to Tetyukhin, et al. which describes use of a Ti-555-3 alloy composed of 5% aluminum, 5% molybdenum, 5% vanadium, 3% chromium, and 0.4% iron in aeronautical engineering applications. However, the Ti-555-3 alloy does not consistently provide the desired high strength, deep hardenability, and excellent ductility required for critical applications in the aviation industry (e.g., landing gear). Moreover, the '043 patent fails to disclose the use of oxygen in its Ti-555-3 alloy, an important element in the composition of titanium alloys. The oxygen percentage is often purposefully adjusted to have a significant impact on strength characteristics.

Another example is provided in U.S. Patent Application Publication No. 2008/0011395 (hereinafter "the '395 application") which describes a titanium alloy which includes aluminum, molybdenum, vanadium, chromium, and iron. However, the weight percentage ranges for the elements of the alloy provided in the publication are overly broad. For example, the alloys Ti-5Al-4.5V-2Mo-1Cr-0.6Fe (VT23) and Ti-5Al-5Mo-5V-1Cr-1Fe (VT22) readily fall within the specified weight percentage ranges. These alloys have been in the public domain dating back to before 1976. Additionally, the preferred ranges of weight percentages provided in the '395 application result in poor strength-ductility combinations. Therefore, the reference does not achieve the desired high strength, deep hardenability, and excellent ductility required for critical applications in the aviation industry such as landing gear.

There therefore is a need for an alloy with improved strength, deep hardenability, and excellent ductility characteristics to meet the needs of critical applications in the aviation industry. The crucial properties for such a product are high tensile strengths (e.g., tensile yield strength ("TYS") and ultimate tensile strength ("UTS")), modulus of elasticity, elongation, and reduction in area ("RA"). Moreover, there is a need for advanced techniques for manufacturing and processing such an alloy to further improve its performance.

SUMMARY OF THE INVENTION

In accordance with the above-described problems, needs, and goals, a high strength near-beta titanium alloy is disclosed. In one embodiment, the titanium alloy includes, in weight %, 5.3 to 5.7% aluminum, 4.8 to 5.2% vanadium, 0.7 to 0.9% iron, 4.6 to 5.3% molybdenum, 2.0 to 2.5% chromium, and 0.12 to 0.16% oxygen with balance titanium and incidental impurities.

In another embodiment, the titanium alloy has a ratio of beta isomorphous ($\beta_{ISO}$) to beta eutectoid ($\beta_{EUT}$) stabilizers of 1.2 to 1.73, or more specifically 1.22 to 1.73, wherein the ratio of beta isomorphous to beta eutectoid stabilizers is defined as:

$$\frac{\beta_{ISO}}{\beta_{EUT}} = \frac{Mo + \frac{V}{1.5}}{\frac{Cr}{0.65} + \frac{Fe}{0.35}}.$$

In the equations provided in this specification, Mo, V, Cr, and Fe respectively represent the weight percentage of molybdenum, vanadium, chromium, and iron in the titanium alloy. In one embodiment, the beta isomorphous value ranges from 7.80 to 8.77 and, in a particular embodiment, is about 8.33. In another embodiment, the beta eutectoid value ranges from 5.08 to 6.42 and, in a particular embodiment, is about 5.82. In a particular embodiment, the ratio of beta isomorphous to beta eutectoid stabilizers is about 1.4, or more specifically 1.43.

In yet another embodiment, the titanium alloy has a molybdenum equivalence ($Mo_{eq}$) of 12.8 to 15.2, wherein the molybdenum equivalence is defined as:

$$Mo_{eq} = Mo + \frac{V}{1.5} + \frac{Cr}{0.65} + \frac{Fe}{0.35}.$$

In a particular embodiment, the molybdenum equivalence is about 14.2. In still another embodiment, the titanium alloy has an aluminum equivalence ($Al_{eq}$) of 8.5 to 10.0 wherein the aluminum equivalence is defined as:

$$Al_{eq}=Al+27O.$$

In this equation Al and O represent the weight percentage of aluminum and oxygen, respectively, in the titanium alloy. In a particular embodiment, the aluminum equivalence is about 9.3. In another embodiment, the titanium alloy has a beta transformation temperature ($T_\beta$) of about 1557 to about 1627° F. (about 847 to about 886° C.), wherein the beta transformation temperature in ° F. is defined as:

$$T_\beta=1594+39.3Al+330O+1145C+1020N-21.8V-32.5Fe-17.3Mo-70Si-27.3Cr.$$

In this equation, C, N, and Si represent the weight % of carbon, nitrogen, and silicon, respectively, in the titanium alloy. In a particular embodiment, the beta transition temperature is about 1590° F. (about 865° C.). In a particular embodiment, the weight % of the aluminum is about 5.5%, the weight % of the vanadium is about 5.0%, the weight % of the iron is about 0.8%, the weight % of the molybdenum is about 5.0%, the weight % of the chromium is about 2.3%, and/or the weight % of the oxygen is about 0.14%.

According to one embodiment, the alloy can achieve excellent tensile properties. As an example, the alloy is capable of achieving a tensile yield strength (TYS) of at least 170 kilopounds per square inch (ksi), an ultimate tensile strength (UTS) of at least 180 ksi, a modulus of elasticity of at least 16.0 megapounds per square inch (Msi), an elongation of at least 10%, and/or a reduction of area (RA) of at least 25%.

According to yet another embodiment the alloy can achieve excellent fatigue resistance. For example, the alloy is capable of achieving a fatigue life of at least 200,000 cycles when a smooth axial fatigue specimen is tested in accordance with ASTM E606 standards at a strain alternating between +0.6% and −0.6%.

According to an embodiment, the alloy composition, utilizing an iron level of 0.7 to 0.9 wt. %, achieves the desired high strength, deep hardenability, and excellent ductility properties required for critical aviation component applications such as landing gear. This result is particularly unexpected in view of the teachings of the prior art, wherein the advantages of using lower amounts of iron are touted. For example, the '043 patent discloses that the use of iron concentrations below 0.5 wt. % is necessary to achieve a higher level of strength for large sized parts.

In accordance with another embodiment of the invention, an aviation system component including the high strength near-beta titanium alloy described herein is provided. In a particular embodiment, the aviation system component comprises landing gear.

In accordance with another embodiment of the invention, a method for manufacturing a titanium alloy for use in applications requiring high strength, deep hardenability, and excellent ductility is provided. The method includes initially providing a high strength near-beta titanium alloy including, in weight %, 5.3 to 5.7% aluminum, 4.8 to 5.2% vanadium, 0.7 to 0.9% iron, 4.6 to 5.3% molybdenum, 2.0 to 2.5% chromium, and 0.12 to 0.16% oxygen with balance titanium and incidental impurities, performing a solution heat treatment of the titanium alloy at temperatures below the beta transformation temperature (e.g., a subtransus temperature), and performing precipitation hardening of the titanium alloy.

In some embodiments, the manufacturing method also includes vacuum arc remelting of the alloy and/or forging and rolling of the titanium alloy below the beta transformation temperature. In a particular embodiment, the disclosed method of manufacturing a high strength, deep hardenability, and excellent ductility alloy is utilized to manufacture an aviation system component, and even more specific to manufacture landing gear.

The accompanying drawings, which are incorporated into and constitute part of this disclosure, illustrate specific embodiments of the disclosed subject matter and serve to explain the principles of the disclosed subject matter.

Figure 1:
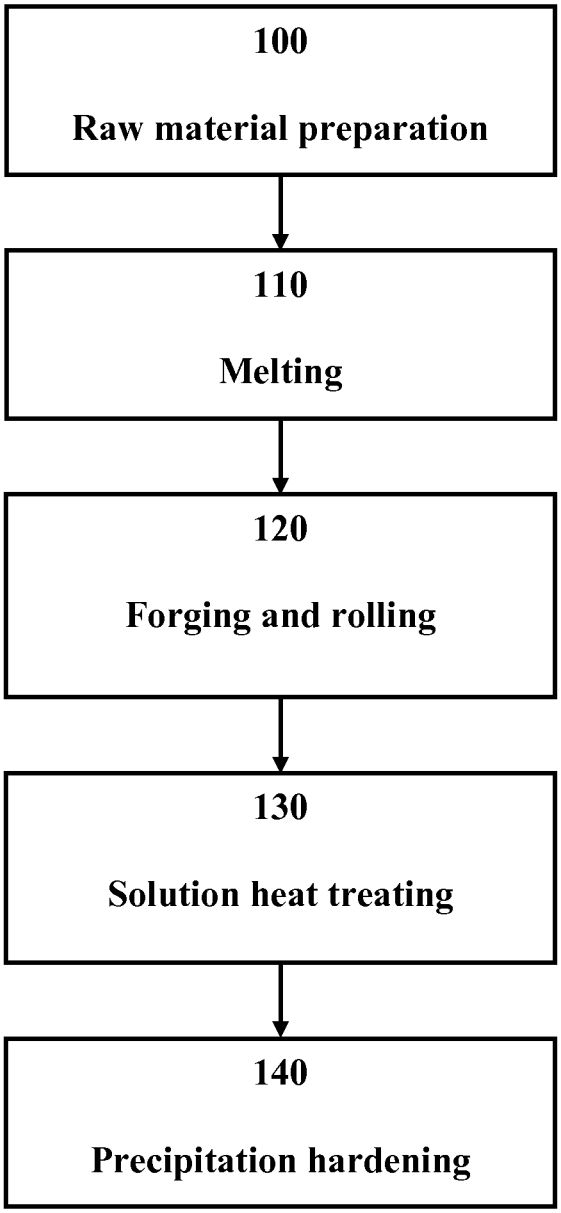
FIG. 1 is a flowchart illustrating a method in accordance with an exemplary embodiment of the presently disclosed invention.

Throughout the drawings, the same reference numerals and characters, unless otherwise stated, are used to denote like features, elements, components or portions of the illustrated embodiments. Moreover, while the disclosed subject matter will now be described in detail with reference to the Figures, it is done so in connection with the illustrative embodiments.

DETAILED DESCRIPTION OF THE INVENTION

A high strength titanium alloy with deep hardenability and excellent ductility is disclosed. Such an alloy is ideal for use in the aviation industry or with other suitable applications where high strength, deep hardenability, and excellent ductility are required.

Techniques for the manufacture of the above-mentioned titanium alloy that are suitable for use in producing aviation components or any other suitable applications are also disclosed. The titanium alloy according to various embodiments disclosed herein is particularly well suited for the manufacture of landing gear, but other suitable applications such as fasteners and other aviation components are contemplated.

In one embodiment, a titanium alloy is provided. The exemplary alloy includes, in weight %, 5.3 to 5.7% aluminum, 4.8 to 5.2% vanadium, 0.7 to 0.9% iron, 4.6 to 5.3% molybdenum, 2.0 to 2.5% chromium, and 0.12 to 0.16% oxygen with balance titanium and incidental impurities.

Aluminum as an alloying element in titanium is an alpha stabilizer, which increases the temperature at which the alpha phase is stable. In one embodiment, aluminum is present in the alloy in a weight percentage of 5.3 to 5.7%. In a particular embodiment, aluminum is present in about 5.5 wt. %. If the aluminum content exceeds the upper limits disclosed in this specification, there can be an excess of alpha stabilization and an increased susceptibility to embrittlement due to $Ti_3Al$ formation. On the other hand, having aluminum below the limits disclosed in this specification can adversely affect the kinetics of alpha precipitation during aging.

Vanadium as an alloying element in titanium is an isomorphous beta stabilizer which lowers the beta transformation temperature. In one embodiment, vanadium is present in the alloy in a weight percentage of 4.8 to 5.2%. In a particular embodiment, vanadium is present in about 5.0 wt. %. If the vanadium content exceeds the upper limits disclosed in this specification, there can be excessive beta stabilization and the optimum hardenability will not be achieved. On the other hand, having vanadium below the limits disclosed in this specification can provide insufficient beta stabilization.

Iron as an alloying element in titanium is an eutectoid beta stabilizer which lowers the beta transformation temperature, and iron is a strengthening element in titanium at ambient temperatures. In one embodiment, iron is present in the alloy in a weight percentage of 0.7 to 0.9%. In a particular embodiment, iron is present in about 0.8 wt. % As mentioned above, utilizing an iron level of 0.7 to 0.9 wt. % can achieve the desired high strength, deep hardenability, and excellent ductility properties required, for example, in critical aviation component applications such as landing gear. If, however, the iron content exceeds the upper limits disclosed in this specification, there can be excessive solute segregation during ingot solidification, which will adversely affect mechanical properties. On the other hand, the use of iron levels below the limits disclosed in this specification can produce an alloy which fails to achieve the desired high strength, deep hardenability, and excellent ductility properties. This is demonstrated, for example, by the properties of the Ti-555-3 alloy described in the '043 parent and is also demonstrated by the testing performed in the Examples described below.

Molybdenum as an alloying element in titanium is an isomorphous beta stabilizer which lowers the beta transformation temperature. In one embodiment, molybdenum is present in the alloy in a weight percentage of 4.6 to 5.3%. In a particular embodiment molybdenum is present in about 5.0 wt. %. If the molybdenum content exceeds the upper limits disclosed in this specification, there can be excessive beta stabilization and the optimum hardenability will not be achieved. On the other hand, having molybdenum below the limits disclosed in this specification can provide insufficient beta stabilization.

Chromium is an eutectoid beta stabilizer which lowers the beta transformation temperature in titanium. In one embodiment, chromium is present in the alloy in a weight percentage of 2.0 to 2.5%. In a particular embodiment, chromium is present in about 2.3 wt. %. If the chromium content exceeds the upper limits disclosed in this specification, there can be reduced ductility due to the presence of eutectoid compounds. On the other hand, having chromium below the limits disclosed in this specification can result in reduced hardenability.

Oxygen as an alloying element in titanium is an alpha stabilizer, and oxygen is an effective strengthening element in titanium alloys at ambient temperatures. In one embodiment, oxygen is present in the alloy in a weight percentage of 0.12 to 0.16%. In a particular embodiment, oxygen is present in about 0.14 wt. %. If the content of oxygen is too low, the strength can be too low, the beta transformation temperature can be too low, and the cost of the alloy can increase because scrap metal will not be suitable for use in the melting of the alloy. On the other hand, if the content is too great, durability and damage tolerance properties may be deteriorated.

In accordance with some embodiments of the present invention, the titanium alloy can also include impurities or other elements such as N, C, Nb, Sn, Zr, Ni, Co, Cu, Si, and the like in order to achieve any desired properties of the resulting alloy. In a particular embodiment, these elements are present in weight percentages of less than 0.1% each, and the total content of these elements is less than 0.5 wt. %.

In accordance with another embodiment of the invention, the titanium alloy has a ratio of beta isomorphous ($\beta_{ISO}$) to beta eutectoid ($\beta_{EUT}$) stabilizers of 1.2 to 1.73, or more specifically 1.22 to 1.73, wherein the ratio of beta isomorphous to beta eutectoid stabilizers is defined in Equation (1):

$$\frac{\beta_{ISO}}{\beta_{EUT}} = \frac{Mo + \frac{V}{1.5}}{\frac{Cr}{0.65} + \frac{Fe}{0.35}}. \quad (1)$$

In the equations provided in this specification, Mo, V, Cr, and Fe respectively represent the weight percent of molybdenum, vanadium, chromium, and iron in the alloy. In one embodiment, the beta isomorphous value ranges from 7.80 to 8.77 and, in a particular embodiment, is about 8.33. In another embodiment, the beta eutectoid value ranges from 5.08 to 6.42 and, in a particular embodiment, is about 5.82. In a specific embodiment, the ratio of beta isomorphous to beta eutectoid stabilizers is about 1.4, or more specifically 1.43.

Utilizing alloys which have a ratio of beta isomorphous to beta eutectoid stabilizers of 1.2 to 1.73 is critical to achieving the desired high strength, deep hardenability, and excellent ductility properties. If the ratio exceeds the upper limits disclosed in this specification, hardenability will be reduced. On the other hand, having a ratio below the limits disclosed in this specification will not achieve the desired high strength, deep hardenability, and excellent ductility properties. This is demonstrated, for example, by properties of the alloys described in the '395 application.

In accordance with another embodiment of the invention, the titanium alloy has a molybdenum equivalence ($Mo_{eq}$) of 12.8 to 15.2, wherein the molybdenum equivalence is defined in Equation (2) as:

$$Mo_{eq} = Mo + \frac{V}{1.5} + \frac{Cr}{0.65} + \frac{Fe}{0.35}. \quad (2)$$

In a particular embodiment, the molybdenum equivalence is about 14.2. In still another embodiment, the alloy has an aluminum equivalence ($Al_{eq}$) of 8.5 to 10.0, wherein the aluminum equivalence is defined in Equation (3) as:

$$Al_{eq} = Al + 27O \quad (3)$$

In this equation, Al and O represent the weight percent of aluminum and oxygen, respectively, in the alloy. In a particular embodiment, the aluminum equivalence is about 9.3. In yet another embodiment, the titanium alloy has a beta transformation temperature ($T_\beta$) of about 1557 to about 1627° F. (about 847 to about 886° C.), wherein the beta transformation temperature in ° F. is defined in Equation (4) as:

$$T_\beta = 1594 + 39.3Al + 330O + 1145C + 1020N - 21.8V - 32.5Fe - 17.3Mo - 70Si - 27.3Cr. \quad (4)$$

In this equation, C, N, and Si represent the weight % of carbon, nitrogen, and silicon, respectively, in the titanium alloy. In a particular embodiment, the beta transition temperature is about 1590° F. (about 865° C.).

The alloy achieves excellent tensile properties having, for example, a tensile yield strength (TYS) of at least 170 ksi, an ultimate tensile strength (UTS) of at least 180 ksi, a modulus of elasticity of at least 16.0 Msi, an elongation of at least 10%, and/or a reduction of area (RA) of at least 25%. Specific examples of tensile properties achieved by exemplary alloys disclosed in this specification are listed in the Examples explained below. The alloy also achieves excellent fatigue resistance, being capable of achieving, for example, a fatigue life of at least 200,000 cycles when a smooth axial fatigue specimen is tested in accordance with ASTM E606 at a strain alternating between +0.6% and −0.6%.

In accordance with another embodiment, an aviation system component comprising the high strength near-beta titanium alloy described herein above is provided. In a particular embodiment, the titanium alloy presented herein is used for the manufacture of landing gear. However, other suitable applications for the titanium alloy include, but are not limited to, fasteners and other aviation components.

In accordance with another embodiment, a method for manufacturing a titanium alloy for use in high strength, deep hardenability, and excellent ductility applications is provided. The method includes providing a high strength near-beta titanium alloy consisting essentially of, in weight %, 5.3 to 5.7% aluminum, 4.8 to 5.2% vanadium, 0.7 to 0.9% iron, 4.6 to 5.3% molybdenum, 2.0 to 2.5% chromium, and 0.12 to 0.16% oxygen with balance titanium and incidental impurities, performing a solution heat treatment of the titanium alloy at a subtransus temperature (e.g., below the beta transformation temperature), and performing precipitation hardening of the titanium alloy. The titanium alloy used can have any of the properties described herein above.

In some embodiments, the manufacturing method also includes vacuum arc remelting the alloy and/or forging and rolling the titanium alloy below the beta transformation temperature. In a particular embodiment, the method of manufacturing a high strength, deep hardenability, and excellent ductility alloy is used to manufacture an aviation system component, and even more specifically, to manufacture landing gear.

FIG. 1, which is presented for the purpose of illustration and not limitation, is a flowchart showing an exemplary method for the manufacture of titanium alloys. In step 100 the desired quantity of raw materials are prepared. The raw materials may include, for example, virgin raw materials comprising titanium sponge and any of the alloying elements disclosed in this specification. Alternatively, the raw materials may comprise recycled titanium alloys such as machining chips or solid pieces of titanium alloys having the appropriate composition. Quantities of both virgin and recycled raw materials may be mixed in any combination known in the art.

After the raw materials are prepared in step 100, they are melted in step 110 to prepare an ingot. Melting may be accomplished by processes such as vacuum arc remelting, electron beam melting, plasma arc melting, consumable electrode scull melting, or any combinations thereof. In a particular embodiment, the final melt in step 110 is conducted by vacuum arc remelting. Next, the ingot is subjected to forging and rolling in step 120. The forging and rolling is performed below the beta transformation temperature (beta transus). The ingot is then solution heat treated in step 130, which, in a particular embodiment, is performed at a subtransus temperature. Solution heat treatment in this embodiment was performed at a temperature at least about 65° F. below the beta transition temperature. Finally, the ingot samples are precipitation hardened in step 140.

In some embodiments the steps of forging and rolling (120), solution treating (130) and precipitation hardening (140) are controlled in a manner to produce a microstructure consisting of fine alpha particles. Additional details on the exemplary method for manufacturing titanium alloys are described in the Examples which follow.

EXAMPLES

Vacuum arc remelting ("VAR") was used to prepare an ingot in accordance with embodiments disclosed in this specification as well as ingots of conventional titanium alloys, Ti-10-2-3 and Ti-555-3, for the purpose of comparison. Each ingot was approximately eight inches in diameter and weighed about 60 pounds. The chemical compositions of the alloys in weight percentage are provided in Table 1 below:

TABLE 1

Chemical Composition (wt %) of Example Alloys

| Alloy | Alloy Type | Al | V | Fe | Mo | Cr | O | N | Ni | $Mo_{eq}$ |
|---|---|---|---|---|---|---|---|---|---|---|
| Ti-10-2-3 | Ti—10V—2Fe—3Al | 2.97 | 10.09 | 1.799 | 0.01 | 0.013 | 0.144 | 0.009 | 0.009 | 11.9 |
| Ti-555-3 | Ti—5Al—5V—5Mo—3Cr | 5.49 | 4.94 | .372 | 4.88 | 2.95 | 0.142 | 0.005 | 0.008 | 13.8 |
| Exemplary Alloy #1 | Ti—5.5Al—5V—0.8Fe—2.3Cr—0.14O | 5.3 | 4.77 | 0.732 | 4.79 | 2.27 | 0.128 | 0.005 | 0.008 | 13.6 |

Final forging and rolling of the ingot samples was performed below the beta transformation temperature (beta transus). The ingot samples were then solution heat treated at a subtransus temperature. Finally the ingot samples were precipitation hardened. The results of the tests are summarized in Table 2 below:

TABLE 2

Tensile Properties of Sample Ingots

| Alloy | Solution Heat Treat | Age | 0.2% TYS (ksi) | UTS (ksi) | Modulus (Msi) | Elong. (%) | RA (%) |
|---|---|---|---|---|---|---|---|
| Ti-10-2-3 | 1435° F., 1 hr, | 975° F., 8 hrs, | 157.2 | 168.2 | 15.3 | 7.7 | 20 |
| Ti-10-2-3 | Air Cool | Air Cool | 157.5 | 168.8 | 15.2 | 7.7 | 18 |
| Ti-555-3 | 1500° F., 1 hr, | 1150° F., 8 hrs, | 176.7 | 190.3 | 16.1 | 12.8 | 36 |
| Ti-555-3 | Air Cool | Air Cool | 177.7 | 191.2 | 16.2 | 13.0 | 33 |
| Exemplary Method #1 | 1500° F., 1 hr, Air Cool | 1125° F., 8 hrs, Air Cool | 184.1 | 196.8 | 16.2 | 14.4 | 46 |
| Exemplary Method #2 | | | 185.5 | 198.5 | 16.4 | 14.4 | 47 |

Figure 2:
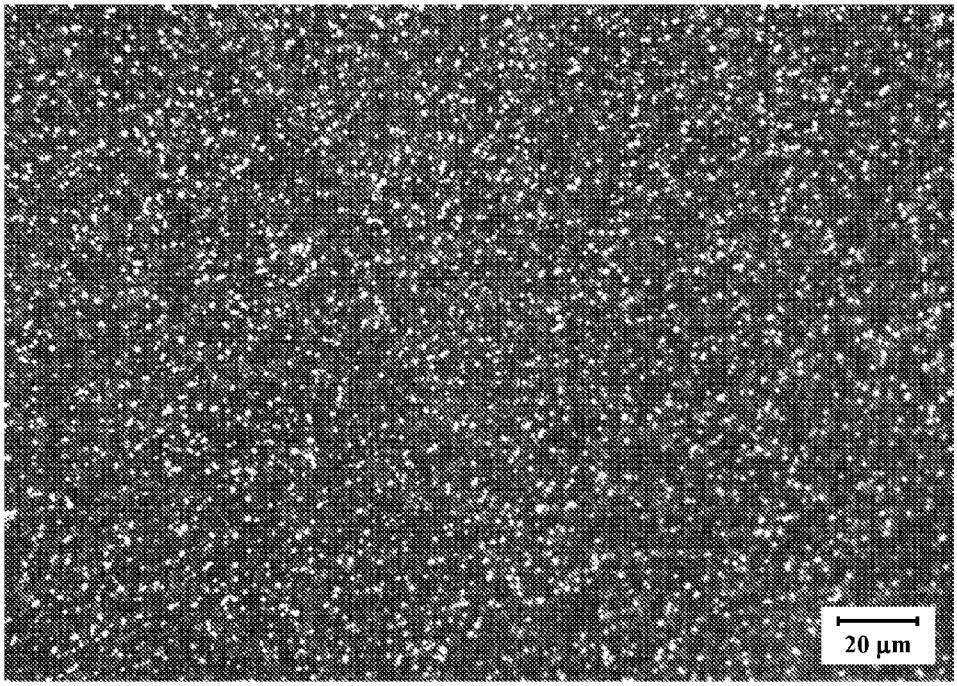
FIG. 2 is a photomicrograph of an exemplary titanium alloy manufactured according to an embodiment of the present invention.

As demonstrated in Table 2, the two sample ingots manufactured according to exemplary methods #1 and #2 exhibited properties superior to those of conventional alloys, including higher strengths than the conventional ingots. An optical photomicrograph showing the microstructure typical of exemplary Ti alloys prepared according to embodiments disclosed in this specification is provided in FIG. 2. The photomicrograph shows a plurality of primary alpha particles which are substantially equiaxed with sizes ranging from about 0.5 to about 5 micrometers (μm) in diameter. The primary alpha particles appear primarily as white particles dispersed within a precipitation hardened matrix (i.e., the dark background). The particular Ti alloy shown in FIG. 2 was solution heat treated at a temperature of 1500° F. for 1 hour and then air-cooled to room temperature. This was followed by precipitation hardening at 1050° F. for 8 hours and then cooling to room temperature under ambient conditions.

Figure 3:
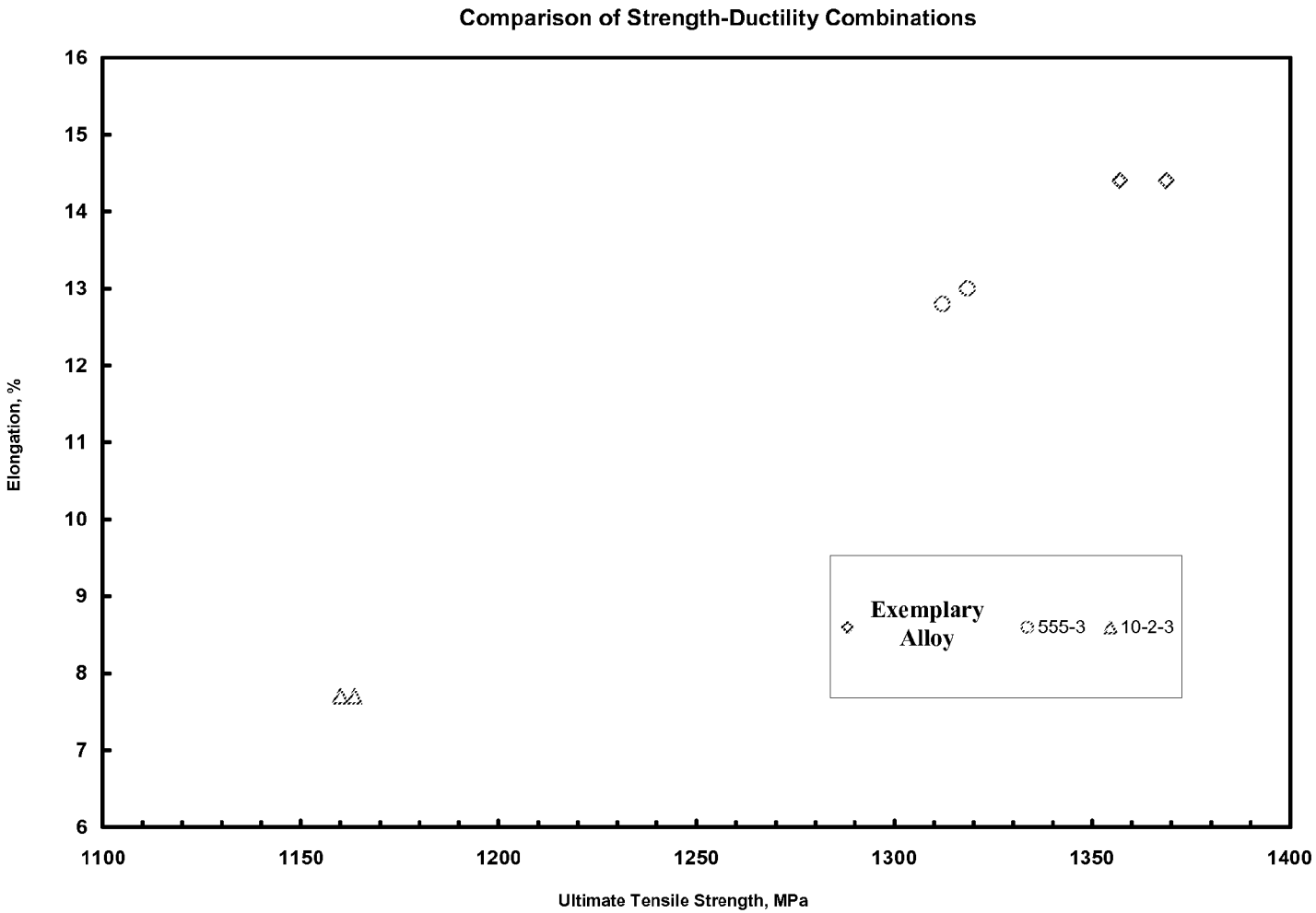
FIG. 3 is a graph comparing the ultimate tensile strength and elongation for exemplary titanium alloys manufactured according to embodiments of the present invention with those for conventional titanium alloys.
Figure 4:
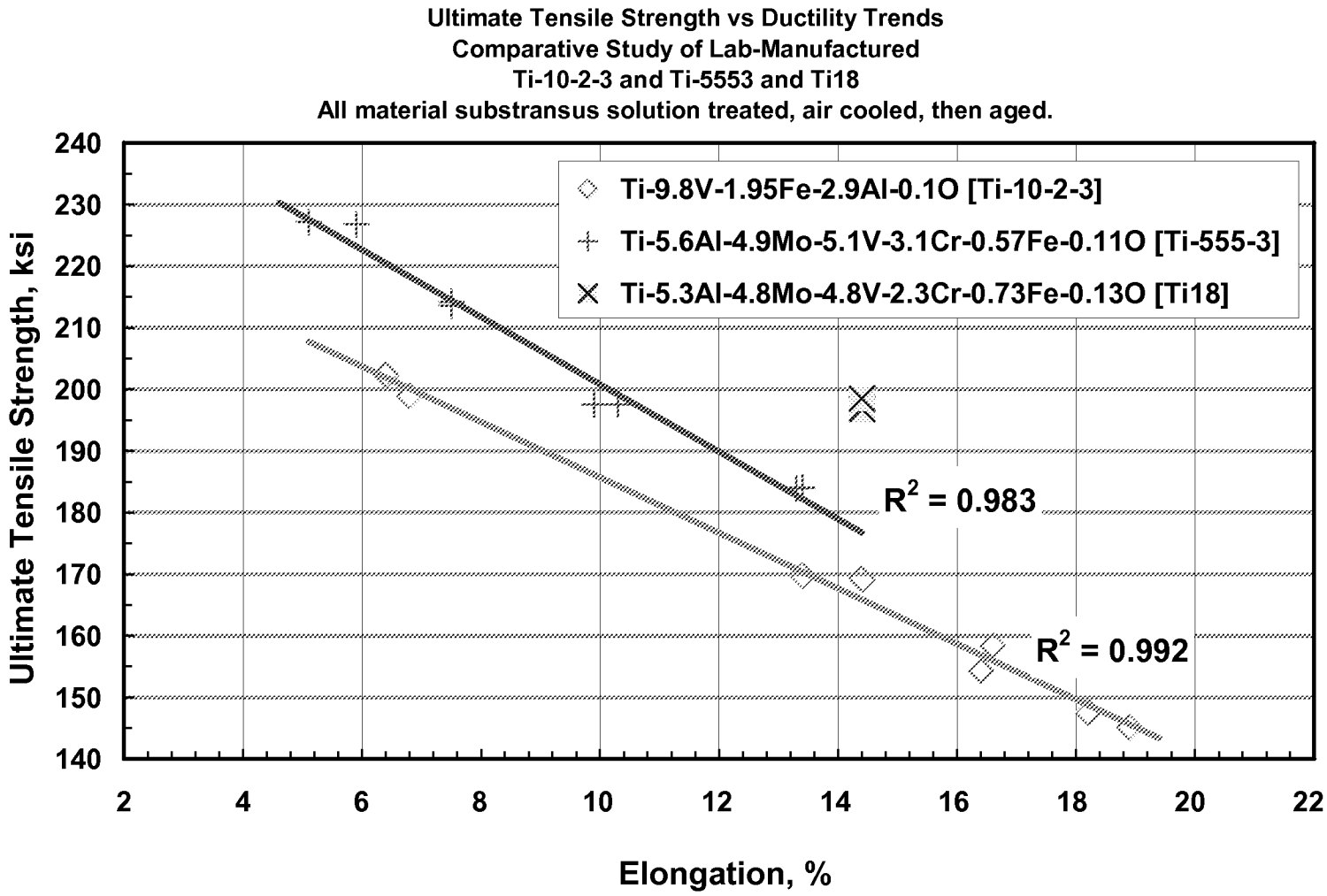
FIG. 4 is another plot comparing the ultimate tensile strength and elongation for exemplary titanium alloys manufactured according to embodiments of the present invention with values obtained for conventional titanium alloys.

FIG. 3 is a plot comparing the ultimate tensile strength and elongation of exemplary Ti alloys of the present invention with prior art Ti alloys. The data provided in FIG. 3 shows that exemplary titanium alloys manufactured according to exemplary methods #1 and #2 have superior strength (e.g., TYS and UTS values) and ductility (e.g., elongation) over conventional titanium alloys. This is due to the unique combination of elements present in the weight percentages disclosed in this specification. The plot provided in FIG. 4 is analogous to that in FIG. 3, but with additional data being provided for the prior art Ti alloys (e.g., the Ti-10-2-3 and Ti-555-3 alloys). In FIG. 4, data obtained for exemplary Ti alloys of the present invention is labeled as Ti18.

A sample 32-inch diameter (12 kilopounds) ingot was produced by triple vacuum arc remelting (TVAR) in accordance with exemplary embodiments disclosed in this specification and the compositional homogeneity was measured across the ingot length. The composition of the ingot was measured at five locations along the length of the ingot, including the top, top-middle, middle, bottom-middle, and bottom and the results are summarized in Table 3 below:

TABLE 3

Compositional Homogeneity of Sample Ingot

| Element (Mass %) or Property | Top | Top-Middle | Middle | Bottom-Middle | Bottom | Average |
|---|---|---|---|---|---|---|
| Al | 5.56 | 5.65 | 5.55 | 5.60 | 5.50 | 5.57 |
| C | 0.012 | 0.014 | 0.012 | 0.012 | 0.011 | 0.012 |
| Cr | 2.30 | 2.35 | 2.33 | 2.36 | 2.38 | 2.34 |
| Fe | 0.711 | 0.722 | 0.731 | 0.749 | 0.787 | 0.740 |
| Mo | 5.12 | 5.17 | 5.07 | 5.08 | 4.94 | 5.08 |
| N | 0.007 | 0.006 | 0.006 | 0.006 | 0.005 | 0.006 |
| Ni | 0.0035 | 0.0035 | 0.0035 | 0.0036 | 0.0039 | 0.004 |
| O | 0.146 | 0.148 | 0.146 | 0.148 | 0.142 | 0.146 |
| Si | 0.032 | 0.031 | 0.030 | 0.030 | 0.033 | 0.031 |
| Sn | 0.010 | 0.015 | 0.014 | 0.015 | 0.013 | 0.013 |
| V | 5.03 | 5.10 | 5.03 | 5.09 | 5.03 | 5.06 |
| Total Other [C, N, Ni, Si, Sn] | 0.061 | 0.066 | 0.062 | 0.063 | 0.062 | 0.063 |
| $T_\beta$, calc, (° F.) | 1595 | 1596 | 1593 | 1593 | 1586 | 1593 |
| $T_\beta$, calc, (° C.) | 868 | 869 | 867 | 867 | 863 | 867 |
| $Mo_{eq}$ | 14.0 | 14.2 | 14.1 | 14.2 | 14.2 | 14.2 |
| $\beta_{ISO}$ | 8.47 | 8.57 | 8.42 | 8.48 | 8.30 | 8.45 |
| $\beta_{EUT}$ | 5.56 | 5.68 | 5.67 | 5.77 | 5.91 | 5.72 |
| $\beta_{ISO}/\beta_{EUT}$ | 1.52 | 1.51 | 1.48 | 1.47 | 1.40 | 1.48 |
| $Al_{eq}$ | 9.5 | 9.6 | 9.5 | 9.6 | 9.3 | 9.5 |

The results provided in Table 3 show that there is excellent compositional uniformity across the entire ingot length, with deviations from average compositions being less than or equal to about 2.8% for all elements measured. The values for $\beta_{ISO}/\beta_{EUT}$, $Mo_{eq}$, $Al_{eq}$, and $T_b$ provided in Table 3 were calculated using Equations 1-4, respectively. Values for $\beta_{ISO}$ and $\beta_{EUT}$ were calculated using the expressions provided in the numerator and denominator of Equation 1, respectively.

In the interest of clarity, in describing embodiments of the present invention, the following terms are defined as provided below:

Tensile Yield Strength: Engineering tensile stress at which the material exhibits a specified limiting deviation (0.2%) from the proportionality of stress and strain.

Ultimate Tensile Strength: The maximum engineering tensile stress which a material is capable of sustaining, calculated from the maximum load during a tension test carried out to rupture and the original cross-sectional area of the specimen.

Modulus of Elasticity: During a tension test, the ratio of stress to corresponding strain below the proportional limit.

Elongation: During a tension test, the increase in gage length (expressed as a percentage of the original gage length) after fracture.

Reduction in Area: During a tension test, the decrease in cross-sectional area of a tensile specimen (expressed as a percentage of the original cross-sectional area) after fracture.

Fatigue Life The number of cycles of a specified strain or stress that a specimen sustains before initiation of a detectable crack.

ASTM E606: The standard practice for strain-controlled fatigue testing.

Alpha stabilizer: An element which, when dissolved in titanium, causes the beta transformation temperature to increase.

Beta stabilizer: An element which, when dissolved in titanium, causes the beta transformation temperature to decrease.

Beta transformation temperature: The lowest temperature at which a titanium alloy completes the allotropic transformation from an α+β to a β crystal structure.

Eutectoid compound: An intermetallic compound of titanium and a transition metal that forms by decomposition of a titanium-rich β phase.

Isomorphous beta stabilizer: A β stabilizing element that has similar phase relations to β titanium and does not form intermetallic compounds with titanium.

Eutectoid beta stabilizer: A β stabilizing element capable of forming intermetallic compounds with titanium.

Other embodiments of the invention will be apparent to those skilled in the art from consideration of the specification and practice of the invention disclosed herein. It is intended that the specification and examples be considered as exemplary only, with a true scope and spirit of the invention being indicated by the claims that follow.

It will be appreciated by persons skilled in the art that the present invention is not limited to what has been particularly shown and described in this specification. Rather, the scope of the present invention is defined by the claims which follow. It should further be understood that the above description is only representative of illustrative examples of embodiments. For the reader's convenience, the above description has focused on a representative sample of possible embodiments, a sample that teaches the principles of the present invention. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent. Furthermore, all references, publications, U.S. patents, and U.S. patent application Publications cited throughout this specification are incorporated by reference as if fully set forth in this specification.

All percentages are in percent by weight (wt. %) in both the specification and claims.

What is claimed is:

1. A titanium alloy consisting of, in weight %, 5.3 to 5.7 aluminum, 4.8 to 5.2 vanadium, 0.7 to 0.9 iron, 4.6 to 5.3 molybdenum, 2.0 to 2.5 chromium, and 0.12 to 0.16 oxygen and the balance titanium together with any incidental impurities having a UTS of at least 180 ksi and an elongation of at least 14.4%, wherein the titanium alloy is manufactured by a. conducting a final melt step by vacuum arc remelting;

b. final forging and rolling the alloy at a temperature below the beta transus, c. performing a solution heat treatment of the titanium alloy at a subtransus temperature; and d. performing precipitation hardening of the titanium alloy.

* * * * *